United States Patent [19]

Machata

[11] 4,005,720

[45] Feb. 1, 1977

[54] SPRAY NOZZLE

[76] Inventor: Charles Machata, 3 Shore Road, Rye, N.Y. 10580

[22] Filed: Aug. 4, 1975

[21] Appl. No.: 601,624

[52] U.S. Cl. ..... 132/9; 132/40; 239/567

[51] Int. Cl.[2] ..... A45D 1/00

[58] Field of Search ..... 239/556, 557, 566, 567; 222/207; 132/9, 33, 39, 40

[56] References Cited

UNITED STATES PATENTS

| | | | |
|---|---|---|---|
| 1,605,839 | 11/1926 | Herman | 239/559 X |
| 2,510,664 | 6/1950 | Shield | 132/9 |
| 2,948,284 | 8/1960 | Zakavin | 132/9 |
| 3,095,151 | 6/1963 | MacChesney | 239/567 X |
| 3,266,561 | 8/1966 | Beachler et al. | 239/567 X |
| 3,521,647 | 7/1970 | Mercer | 132/9 |
| 3,680,565 | 8/1972 | Giles et al. | 132/9 |

*Primary Examiner*—John J. Love
*Assistant Examiner*—Michael Mar
*Attorney, Agent, or Firm*—Paul R. Audet

[57] ABSTRACT

A spray nozzle having one or more elongated, tunnel-shaped channels, each formed by a top wall, and two fixed substantially vertically depending side walls for encompassing substantially the entire body of an elongated object such as a permanent wave rod or hair curler, the walls having perforations therein for directing a liquid spray at substantially the entire body of the object when it is axially in the channel.

8 Claims, 7 Drawing Figures

SPRAY NOZZLE

BACKGROUND OF THE INVENTION

This invention relates to spray nozzles, particularly those for commercial and home use for directing a spray of liquid, usually water, onto human or synthetic hair.

Typically, hair spray nozzles are used to direct a spray of water under pressure onto hair coiled or wrapped around objects, for example, rollers, permanent wave rods, and hair curlers, placed close to or on a human head or a wig. The sprayed water is employed to wash, or rinse, or saturate the hair after it has been treated in some manner, for example, with chemical liquids, lotions, solutions and materials to dye, frost, tint, permanently wave or set the hair for desired effects.

Although a timely and thorough removal of chemical materials from all portions of the hair by saturation of and/or neutralization of the chemicals with water is critical for providing uniform or other desired shades, tints and effects, and for preventing split ends, undue drying and other damage to the hair, such cannot readily be accomplished with presently known hair spray nozzles. Such nozzles do not direct water at hair near the scalp and on the undersides and undersurfaces of hair curlers. Conventional nozzles usually only provide vertical perforations in a flat spray plate for directing a spray in only a single direction. Also, conventional spray plates are too large to fit between adjacent hair curlers on a human head prepared for receiving say, a permanent wave. Conventional nozzles therefore are held over the head, or over outer portions of hair curlers and only direct water at and only quickly saturate and neutralize chemicals on upper hair strand portions on upper portions of hair curlers, i.e., those portions which do not face the scalp. Lower hair strand portions near the scalp and on undersides and undersurfaces of hair curlers are not simultaneously or directly struck with clean water. These usually only receive indirect, chemical-carrying run-off water from upper hair strand portions, and chemicals on these lower hair portions are therefore not at all or only partially saturated and neutralized with water. The failure to quickly or thoroughly rinse, saturate, neutralize or remove all chemicals from lower hair strand portions often causes undesired variations in hair shading and effects.

In view of these and other shortcomings of conventional spray nozzles, it is an object of this invention to provide a spray nozzle which directs a spray of liquid such as water at substantially the entire body of an elongated object, for example, a cylindrical or substantially cylindrical object such as a permanent wave rod or hair curler.

Another object of this invention is to provide an aforementioned spray nozzle whose spray is capable of quickly removing all or substantially all chemical materials such as permanent wave solution from hair on a permanent wave rod or hair curler. Another object of this invention is to provide an aforementioned spray nozzle that is capable of simultaneously directing a spray of liquid at hair on substantially the entire circumference of one or more hair curlers.

Another object of this invention is to provide an aforementioned spray nozzle having a channel formed of a top wall and fixed, substantially vertically depending side walls, each wall having perforations therein which direct a spray of liquid at substantially the entire body of an elongated object, for example a hair curler, axially positioned in the channel.

Another object of this invention is to provide an aforementioned spray nozzle which includes a plurality of channels, spaced from and parallel to each other.

These and other objects of this invention will be apparent as it is better understood from the description which follows, which, taken in conjunction with the drawings, discloses preferred embodiments thereof.

DETAILED DESCRIPTION OF THE INVENTION

Figure 1:
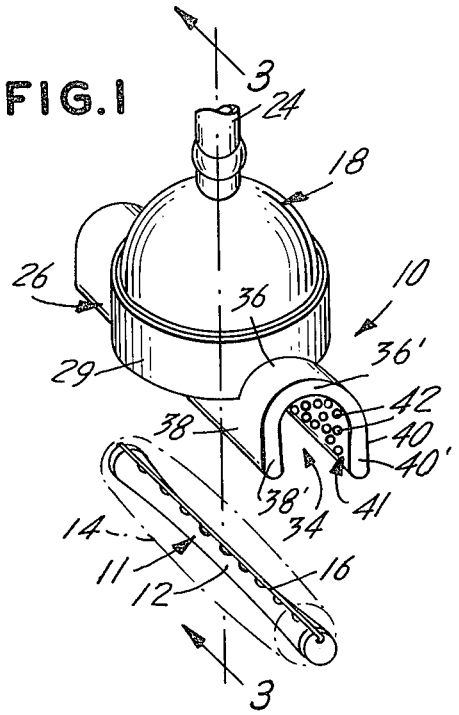
FIG. 1 is a perspective view of a hair spray device, a portion of which is an embodiment of the spray nozzle of this invention, overlying a hair curler or permanent wave rod.

Referring to the drawings in detail, FIG. 1 shows a spray device, generally designated 10, overlying an elongated object such as a cylindrical or substantially cylindrical hair roller, permanent wave rod or hair curler 11, having a perforated or, as shown, unperforated trunk or body 12 whose length in turn has synthetic, artificial or natural hair 14 (interrupted line) wrapped or coiled thereabout and removably held thereon by suitable means such as retainer 16. More particularly, FIG. 1 shows that spray device 10 includes a conventional bell-shaped nozzle head 18 having a cavity 19 and a tubular inlet 20 (FIG. 3), in turn having means such as annular bead 22 thereon for hermetically securing a flexible hose 24 thereto. Secured to the rim of bell-shaped member 18 is a preferred embodiment of the spray nozzle of this invention, generally designated 26, which includes suitable means such an annular threads 28 (FIG. 3) cooperative with annular threads 30 on bell-shaped member 18 and with annular washer 48 for hermetically and removably securing spray nozzle 26 to bell-shaped member 18. Spray nozzle 26 includes a housing, generally designated 29, which in turn includes an interior chamber 32 having an entrance 33 (FIG. 3), and an exterior, elongated, tunnel-shaped channel 34 formed by a top wall 36, and merging therewith, two depending side walls 38, 40 each respectively having end surfaces 36', 38' and 40'. The top and side walls are structured to cooperatively encompass substantially the entire body of an elongated object such as hair curler 11 when it is axially in position within channel 34. "Encompass substantially the entire body of" here means that the walls enclose, surround or extend around or about most of or at least three-quarters of, the body of the elongated object, such that although the channel is open-bottomed to allow the spray nozzle to be placed and seated directly over the object, a straight line can be drawn from the bottom edge of one side wall to that of the other side wall without passing through the object pin the channel. The interior wall portions of the top and side walls form channel spray wall 41 having perforations 42 therein which so positioned that they are capable of directing a spray of liquid therethrough at substantially the entire body 12 when it is axially in the channel. FIG. 1 shows that channel 34 is not only open-bottomed for placement over hair curler 11, but preferably also is open-ended to allow easy escape and removal of sprayed liquid from channel 34.

Figure 2:
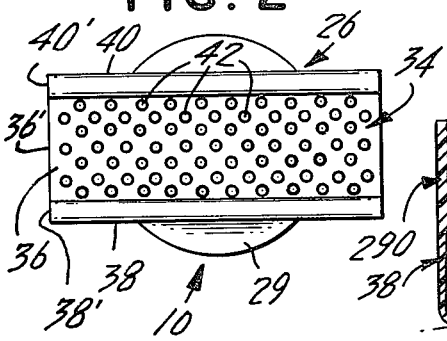
FIG. 2 is a bottom view of the spray nozzle of FIG. 1

FIG. 2, a bottom view of spray nozzle 26 of FIG. 1, shows the longitudionally extending bottom edges of side walls 38, 40, and shows that side walls 38, 40 are spaced from and parallel to each other, and form channel 34 therebetween. FIG. 2 also shows perforations 42 in the interior wall portion of top wall 36.

Figure 3:
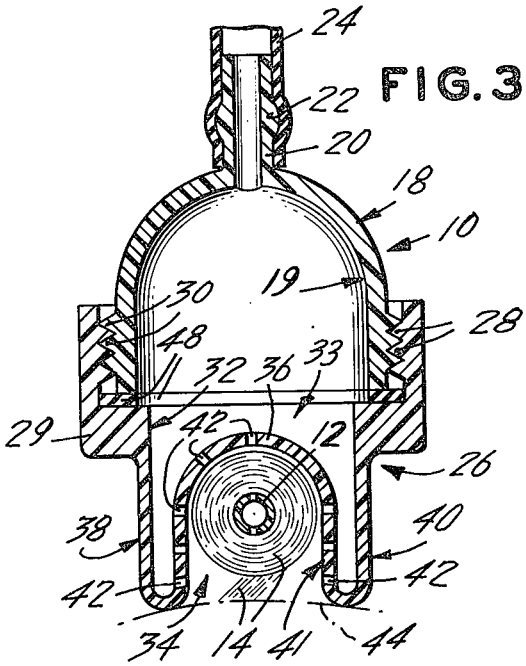
FIG. 3 is a cross-section as would be taken along line 3—3 of FIG. 1, were the spray nozzle placed over the hair curler of FIG. 1.

FIG. 3 is a cross-section taken along line 3—3 through spray device 10 and through hair curler 11 having hair 14 of a human scalp or wig 44 (interrupted line) wound therearound, when spray nozzle 26 is positioned over and channel spray wall 41 of channel 34 encompasses substantially the entire body 12 of hair curler 11. More particularly, FIG. 3 shows that chamber 32 of spray nozzle 26 extends from its entrance 33 to the lower extremeties of side walls 38, 40, and that perforations 42 in channel spray wall 41 are capable of directing a spray of liquid simultaneously and in different directions at substantially the entire circumference of hair curler 11. It is to be noted that perforations are positioned along, near or adjacent the bottom edge portions of side walls 38, 40 to direct sprays of water at portions of hair 14 extending from scalp 44 to hair curler 11, and at lower hair strand portions on underside or underneath portions of hair curler body 12. Preferably, a sufficient number of these lower perforations are aimed in directions whose angles are less than 90° relative to the vertical axis of depending side walls 38, 40. Also, the vertical height of channel 34, and preferably of the interior wall portions of side walls 38, 40, which form channel spray 41, are longer than the height of the elongated object, the diameter of the cylindrical object, or the longest diameter of the substantially cylindrical object, here, hair curler 12, that is to be substantially encompassed by channel spray wall 41. The width of the channel from side wall bottom edge to side wall bottom edge is greater than the transaxial width or longest diameter of the elongated object to be positioned therein. These factors allow the perforations in the walls to spray liquid at side and bottom portions of the body of the elongated object in channel 34.

In operation, a liquid such as water (not shown) under pressure from a source (not shown) flows through flexible hose 24, through tubular inlet 20 and into cavity 19 of conventional bell-shaped member 18. Since spray nozzle 26 is threadedly and hermetically secured to bell-shaped member 18, the water passes directly through cavity 19, past annular washer 4, into spray nozzle interior chamber 32 and through perforations 42, each of which directs an individual, and each of which cooperates to direct a collective, spray of water into channel 34 simultaneously at substantially the entire body of hair curler body 12 and at any hair thereon, in channel 34.

Figure 4:
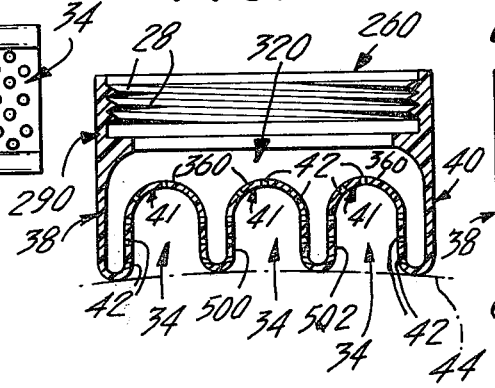
FIG. 4 is a vertical cross-section through an alternative embodiment of the spray nozzle of this invention.

FIG. 4 is a vertical cross-section through an alternative embodiment of the spray nozzle of this invention. More particularly, FIG. 4 shows a modified spray nozzle 260 which includes a housing, generally designated 290, having interior annular threads 28 for threadedly and hermetically securing itself to bell-shaped member 18 (FIG. 3) or a similar conventional member in a manner such as shown in FIG. 3. Spray nozzle 260 includes a plurality of open-ended, elongated, tunnel-shaped channels 34 parallel to and spaced from each other, and formed by side walls 38, 40 and common side walls 500, 502. The bottom edge portions of each side wall are shown in contact with scalp 44. Each channel 34 is defined by its respective channel spray wall 41 formed of the interior wall portions of integral top wall 360, of side walls 38, 40 and of common side walls 500, 502. Channel spray walls 41 have perforations 42 therein which communicate with channel 34 and chamber 320. Chamber 320 extends into the lowest extremity of each side for carrying water to and allowing perforations 42 to simultaneously direct a water spray simultaneously and in different directions at the entire top and side and bottom portions of the length of the body of an elongated, cylindrical, or substantially cylindrical, object such as hair curler 11. Each of the plurality of channels 34 can encompass a hair curler 11 for quickly and totally saturating chemicals on hair coiled on each hair curler. FIG. 4 shows that side walls 40, 38 need not be, but preferably are, slightly longer than common side walls 500, 502 to allow spray nozzle 260 to conform to the curvature of scalp 44.

Figure 5:
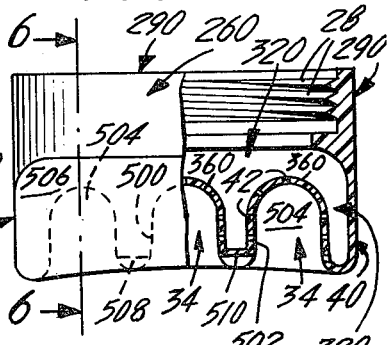
FIG. 5 is a front elevation, partly in section, of another embodiment of the spray nozzle of FIG. 4.

FIG. 5 is a front elevation, partially in section, of an alternative embodiment of the spray nozzle of this invention. FIG. 5 shows that spray nozzle 260 (26 of FIG. 1 or 2600 of FIG. 7) can have end walls such as 504, 506 which depend from each end of top wall 360, and which, as shown, can merge with the ends of top and side walls 36', 38' and 40' of FIG. 1. End walls 504, 506 cooperate with the top and side walls in defining the plurality of respective channels 34. Preferably, the bottom edges of the end walls combine to form a continuous end wall which extends from exterior side wall 38 to side wall 40 and which is concavely-shaped to conform to the shape of the scalp or head (not shown).

Figure 6:
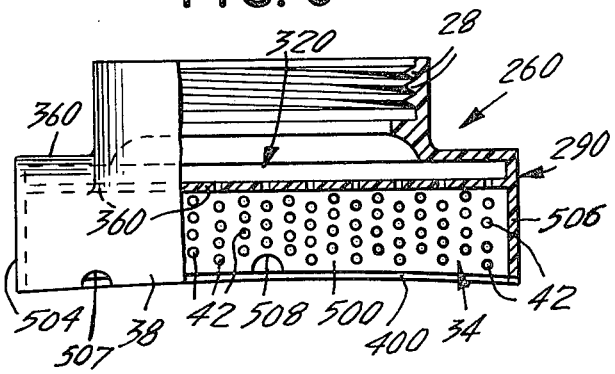
FIG. 6 is a front elevation, partly in section, taken substantially along line 6—6 of FIG. 5.

FIGS. 5 and 6, the latter being a front elevation, partially in section, taken substantially along line 6—6 of FIG. 5, show that portions of, say the bottom edges of, side wall 38 and/or 40 and common walls 500, 502 can have one or more openings 507, 508 (dashed line) and 510 therein for allowing sprayed fluid to flow therethrough for escape from channels 34. Openings can be provided in any suitable number and configuration in any portions of any of the side walls or end walls to expedite fluid drainage, as desired.

Figure 7:
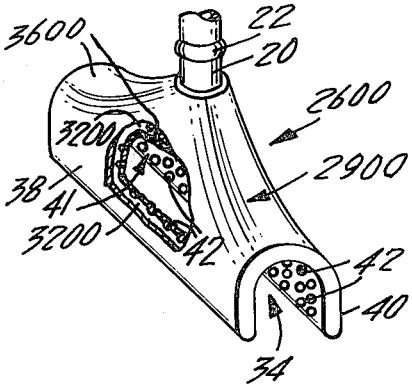
FIG. 7 is a perspective view of another embodiment of the spray nozzle of this invention.

FIG. 7, a perspective view, with portions broken away, of another embodiment of the spray nozzle of this invention, shows that the spray nozzle of this invention need not be adapted to be threadedly or otherwise secured to a separate conventional spray nozzle head such as bell-shaped member 18. Rather, the spray nozzle can be a one-piece structure 2600 having tubular inlet 20, in turn having suitable means such as bead 22 for attaching the nozzle inlet to a flexible hose (not shown). Spray nozzle 2600 includes a housing 2900 which in turn includes chamber 3200 and exterior, elongated, tunnel-shaped channel 34 formed by top wall 3600, and, merging therewith, depending side walls 38 and 40. The interior wall portions of top wall 3600 and side walls 38 and 40 together form channel spray wall 41 having perforations 42 therein which communicate with the chamber and channel for directing a spray of liquid through the perforations at substantially the entire body or length of the top, side, and bottom portions of an elongated object such as a hair curler, (not shown) when it is in position within and substantially encompassed by channel spray wall 41.

Although not shown in FIG. 7, the ends of respective top and side walls 3600, 38 and 40 can have merging end walls such as shown in FIG. 5, and, the bottom edges of side walls 38 and 40 and the end walls can have one or more openings therein, as shown in FIGS. 5 and 6.

The top and side walls of this invention can be separate pieces, but preferably they are integral, as in channel spray wall 41, and they can be of any suitable size and shape so long as they substantially encompass the object to be sprayed. The channels of this invention can be of any suitable shape. Although arcuate top walls are especially suitable for conforming to cylindrically-shaped hair curlers, top walls 36, 360 and 3600 could for example, be horizontal, substantially horizontal, or peaked. As shown in the drawings the spray nozzles of this invention can include any suitable number of arrangement of channels depending on the number and arrangements of objects to be encompassed and sprayed at one time.

Chambers 32, 320 and 3200 can be of any suitable size and shape so long as they are sufficient to pass water from the source to the perforations wherever they are located and to provide a pressurized liquid spray that will reach and wet portions of the object, hair curler, or hair in the channel.

Spray nozzles 26, 260 and 2600 of this invention can be made of any suitable material, for example, rubber, plastic, metal, wood or combinations thereof. The nozzles can be molded of a suitable plastic and can have a separate channel spray wall or plate suitably secured thereto, and made of the same or a different material than the housing. Preferably, the housing is a rigid or substantially rigid material, although some flexibility may be provided for example to allow the spray nozzle, particularly, its side wall portions to flex, conform and adjust to the scalp.

Perforations 42 can be provided in any suitable shape, number, and array, in any of the walls, so long as a sufficient number are provided low enough in the side walls to spray the side and bottom portions of the body of the elongated object within the channel. Preferably, the lowermost perforations are angled upward to direct a spray towards the lower portions of the object. Such angled perforations are especially suitable for spraying lower hair strand portions on hair curlers in view of the space or gap often found between the scalp and hair curler (FIG. 3). Combinations of upwardly-aimed and horizontally-aimed perforations are desirable since the latter additionally direct a spray at hair extending between the scalp and a hair curler.

It is to be noted that according to this invention, "hair curler" includes any elongated, cylindrical or substantially cylindrical object about which hair is wrapped, and specifically includes a permanent wave rod.

It is thought that the invention and many of its attendant advantages will be understood from the foregoing description, and it is apparent that various changes may be made in the form, construction, and arrangement of the parts, without departing from the spirit and scope of the invention or sacrificing all of its material advantages, the parts of structures hereinbefore described being merely preferred embodiments thereof.

I claim:

1. A spray nozzle for directing a spray of liquid at substantially the entire body of an elongated object, comprising:

a substantially rigid housing which includes a chamber for receiving liquid under pressure from a source, and an elongated channel formed by an integral top wall, and, merging therewith, two substantially vertically depending side walls, the side walls having bottom edges spaced from each other such that the channel width from side wall bottom edge to side wall bottom edge is greater than the transaxial width or longest diameter of the elongated object, the top and side walls being structured to encompass substantially the entire body of the elongated object and having perforations therein which communicate with the chamber and the channel and are so positioned in the top and side walls that they are capable of directing and do direct a spray of liquid therethrough at substantially the entire body including the bottom of the object when the body is axially in position within the channel wherein said object is a hair curler or permanent wave rod and the liquid spray is directed against hair wrapped therearound.

2. The spray nozzle of claim 1 further comprising means for securing the spray nozzle to a nozzle head.

3. The spray nozzle of claim 1 wherein the spray nozzle includes a plurality of the channels.

4. The spray nozzle of claim 2 wherein the spray nozzle includes a plurality of the channels.

5. The spray nozzle of claim 4 wherein the plurality of channels are parallel to and spaced from each other.

6. The spray nozzle of claim 1 wherein the side walls have bottom edges and some of the perforations are so positioned in the side walls adjacent their bottom edges that the perforations direct a liquid spray at an angle less than 90° relative to the substantially vertically depending side walls in which the perforations occur.

7. The spray nozzle of claim 1 wherein the spray nozzle includes and the channel is additionally formed by an end wall which depends from each end of the top wall.

8. The spray nozzle of claim 5 wherein the spray nozzle includes and each channel is additionally formed by, an end wall which depends from each end of the top wall, and wherein the side walls have bottom edges which include openings therein which communicate with adjacent channels for allowing interchannel flow of liquid.

* * * * *